US012403944B2

(12) United States Patent
Strössner et al.

(10) Patent No.: US 12,403,944 B2
(45) Date of Patent: Sep. 2, 2025

(54) ARRANGEMENT FOR TRAIN PROTECTION

(71) Applicant: Siemens Mobility GmbH, Munich (DE)

(72) Inventors: Christian Strössner, Grossenseebach (DE); Florian Bolze, Krefeld (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 18/857,030

(22) PCT Filed: Mar. 15, 2023

(86) PCT No.: PCT/EP2023/056542
§ 371 (c)(1),
(2) Date: Oct. 15, 2024

(87) PCT Pub. No.: WO2023/198391
PCT Pub. Date: Oct. 19, 2023

(65) Prior Publication Data

US 2025/0115284 A1 Apr. 10, 2025

(30) Foreign Application Priority Data

Apr. 12, 2022 (DE) ..... 10 2022 203 703.0

(51) Int. Cl.
*B61L 27/04* (2006.01)
*B61L 3/22* (2006.01)
*B61L 27/20* (2022.01)

(52) U.S. Cl.
CPC ..... *B61L 27/04* (2013.01); *B61L 3/225* (2013.01); *B61L 27/20* (2022.01); *B61L 2003/226* (2013.01); *B61L 2027/202* (2022.01)

(58) Field of Classification Search
USPC ..... 701/19
See application file for complete search history.

(56) References Cited

U.S. PATENT DOCUMENTS 11,814,091 B2 * 11/2023 Rush ..... B61G 7/14
2018/0170412 A1 * 6/2018 Fischer ..... B61L 15/0063

FOREIGN PATENT DOCUMENTS

DE 102008022343 A1 11/2009
DE 102014206519 A1 10/2015
(Continued)

OTHER PUBLICATIONS

International Electrotechnical Commission, Preview of International Standard, Edition 1.0, Jun. 2012, ISBN 978-2-88912-070-3, pp. 1-13.

*Primary Examiner* — Adam D Tissot
(74) *Attorney, Agent, or Firm* — Laurence A. Greenberg; Werner H. Stemer; Ralph E. Locher

(57) ABSTRACT

An arrangement for train protection includes a rail vehicle with a driver's cabin and a train protection system. The train protection system is coupled to components of an actuator system and to components of a sensor system via a first gateway. The actuator system and the sensor system have antennas as respective components, which are designed for communication of the actuator system and the sensor system with trackside components of the train protection system. The first gateway has a switching functionality so that a line-length-independent connection is realized between the actuator system and the sensor system on the one hand and the train protection system on the other hand.

10 Claims, 4 Drawing Sheets

(56) References Cited

FOREIGN PATENT DOCUMENTS

| | | | | |
|---|---|---|---|---|
| DE | 102020206630 | A1 | | 12/2021 |
| EP | 1681222 | B1 | | 12/2007 |
| WO | WO-2020259966 | A1 | * | 12/2020 |

* cited by examiner

ARRANGEMENT FOR TRAIN PROTECTION

FIELD AND BACKGROUND OF THE INVENTION

The invention relates to an arrangement for train protection comprising a rail vehicle that has a driver's cab, in particular comprising a locomotive.

Train protection systems are used to prevent collisions by rail vehicles in rail traffic. Every lead rail vehicle, that is to say every rail vehicle comprising a driver's cab, contains at least one train protection system.

Examples of known train protection systems are:

ETCS (European Train Control System),
LZB (continuous train control system),
PZB (intermittent train control system),
the SCMT (Sistema di Controllo della Marcia del Treno) system,
the MIREL system,
the SHP (Samoczynne Hamowanie Pociagu) system,
the TGBI (Train Guard Basic Indusi) system,
the ATC/STM-DK system,
the ATB-EG system,
the ATC2 (Automatic Train Control) system,
etc.

Accordingly, a train configuration comprising a driving locomotive and comprising a control car (that is to say comprising a car with an operating head) has two installation locations comprising train protection systems: a first train protection system is located in the locomotive and a second train protection system (of identical design) is located in the control car.

FIG. 3 shows an example of such a train configuration from the known prior art that encompasses a locomotive LOK, multiple cars WA and a control car SW, the control car SW having a driver's cab for controlling and operating the train configuration.

The control car SW is arranged at a first end of the train configuration, while the locomotive LOK is arranged at an opposite second end of the train configuration.

The train configuration is driven by way of the locomotive LOK, which has two driver's cabs FS1, FS2.

The movement of the train configuration is monitored, or controlled, in the manner of the conventional "push-pull concept" either by way of the driver's cab FS1 of the locomotive or by way of a driver's cab FS3 of the control car SW.

When the movement of the train configuration is being monitored, or controlled, by way of the driver's cab FS1 of the locomotive LOK, a train protection system ZUSI-LOK that is provided, or arranged, on the locomotive LOK is used for this purpose.

The train protection system ZUSI-LOK is coupled to components of an associated actuator system AKT-LOK and to components of a sensor system SENS-LOK that are arranged on the locomotive LOK and close to the rails that the locomotive LOK is using.

The components of the actuator system AKT-LOK and of the sensor system SENS-LOK use antennas to communicate with associated components of the train protection system that are arranged, or provided, on the track.

When the movement of the train configuration is being monitored, or controlled, by way of the driver's cab FS3 of the control car SW, a train protection system ZUSI-SW that is provided, or arranged, on the control car SW is used for this purpose.

The train protection system ZUSI-SW is coupled to components of an associated actuator system AKT-SW and to components of a sensor system SENS-SW that are arranged on the control car SW and close to the rails that are being used.

The components of the actuator system AKT-SW and of the sensor system SENS-SW use antennas, which are an element, or an integrated element, of the sensor system or actuator system, to communicate with associated components of the train protection system that are arranged, or provided, on the track.

The comparable train protection systems ZUSI-SW and ZUSI-LOK comprising the associated and comparable components AKT-SW and AKT-LOK, SENS-SW and SENS-LOK are of identical or similar design with the same function and are therefore present twice; they are operated independently of one another.

The control car SW and the locomotive LOK are connected to one another by way of two bus-based connections. The depiction here shows an Ethernet bus ETH of a data connection DV and a fieldbus BUS referred to as a wire train bus, WTB, as specified in DIN EN 61375, for example.

The Ethernet bus ETH of the data connection DV is used to exchange the following control signals:

instructions with respect to heating of the cars WA, or the train configuration,
instructions relating to the air-conditioning of the cars WA, or the train configuration,
instructions relating to the locking and release of doors,
diagnostic information,
etc.

The wire train bus WTB is used to exchange the following communication signals:

control signals with respect to drive,
control signals with respect to raising or lowering of the pantograph of the locomotive LOK,
control signals with respect to braking performed by the entire train configuration,
control signals with respect to alarms (e.g. fire alarm),
control signals with respect to the closing and opening of doors,
etc.

FIG. 4 shows a schematic representation of a known control system architecture in the control car SW with reference to FIG. 3.

The control car SW has driver's cab equipment FSA-SW that comprises the following components, for example: control lever, drive/brake lever, driver's cab displays, autonomous control units, etc.

The control car SW has a controller STGSUB-SW for subsystems in the cars WA, for example a respective controller for brakes, power supply, etc.

The driver's cab equipment FSA-SW and the controller STGSUB-SW are coupled to a vehicle control system FZLT-SW that includes the following components, for example:

a central control unit,
a main controller,
a radio transmission unit,
vehicle-local bus systems,
one or more brake control units,
associated decentralized I/O components,
etc.

The vehicle control system FZLT-SW is coupled to train protection hardware ZUSIHW-SW that includes the following, for example:

components of the European train control system ETCS, or components of other national train control systems, such as LZB, PZB, STM-DK, SCMT, SHP, associated decentralized I/O components, etc.

The train protection hardware ZUSIHW-SW is in turn coupled to the components of the associated actuator system AKT-SW and to the components of the sensor system SENS-SW that are arranged on the control car SW and close to the rails that are being used.

The control-car-sited components of the actuator system AKT-SW and the components of the sensor system SENS-SW are in turn coupled to components of a sensor system SENS-SCH and to components of an actuator system AKT-SCH (or connected to one another by way of antennas) that are elements of rail-sited train protection ZUSI-SCH.

The vehicle control system FZLT-SW is coupled to the aforementioned bus systems WTB, ETH for signal transmission.

In summary, the aforementioned units, or components, ZUSI-SW/LOK, AKT-SW/LOK, SENS-SW/LOK are installed twice on the control car SW and the locomotive LOK to permit control of the train configuration by way of one of the two driver's cabs FS1, FS3.

In reference to the train configuration, said components need to be integrated in the different vehicle types, installed twice and registered separately, which significantly hampers changes, extensions, etc.

Each of said units, or components, in turn requires individual software, which likewise needs to be developed, tested, divided according to versions and registered separately.

This gives rise to high unit costs, very high development and registration effort, and adversely affects the timing of planned market introduction (time-to-market) of an applicable train configuration.

Both such a train configuration and an (individual) locomotive require the antennas used for coupling to be arranged in physical proximity to the associated train protection system; lengthy cable runs from the antenna to the train protection system are out of the question.

Even the use of additional antennas, or of an additional antenna arrangement, at another (installation) location is not possible.

SUMMARY OF THE INVENTION

It is the object of the present invention to specify an arrangement for train protection that is able to be realized irrespective of the hitherto required physical proximity between the antennas and the train protection system.

This object is achieved by way of the features as claimed.

Advantageous developments are specified in the dependent claims.

The arrangement for train protection according to the invention has a rail vehicle that contains a driver's cab and a train protection system.

The rail vehicle considered is, for example, a locomotive that has one or two driver's cabs. The rail vehicle considered in the case of a train configuration is both the locomotive comprising two driver's cabs and the control car comprising one driver's cab. The same applies, mutatis mutandis, to other combinations.

The train protection system is coupled to components of an actuator system and to components of a sensor system by way of a first gateway, the actuator system and the sensor system being arranged on the rail vehicle close to the rails.

The actuator system and the sensor system have, as respective elements, antennas designed to allow the actuator system and the sensor system to communicate with components of the train protection system that are arranged on the track.

The first gateway, as a central gateway, has a mediator functionality, and so a cable-length-independent connection is able to be made between the actuator system and the sensor system on the one hand and the train protection system on the other hand.

From the point of view of the actuator system and the sensor system the first gateway simulates an input interface of the rail-vehicle-sited train protection system.

From the point of view of the train protection system the gateway simulates an input interface of the actuator system and the sensor system.

The first gateway is thus used to provide required antenna signals of the actuator system and the sensor system for the train protection system.

In a preferred development, the first gateway is designed such that besides the actuator system and the sensor system of a first train protection system an actuator system and a sensor system of a second train protection system, or of other train protection systems, are also able to be connected to said first gateway at the same time.

Preferably, the second train protection system is also arranged on the rail vehicle in this case.

The same applies, mutatis mutandis, to the other train protection systems provided on the rail vehicle.

This refinement permits use in rail vehicles that are being used in cross-border traffic and that therefore also have the second train protection system besides the first train protection system.

In a preferred development, the first train protection system is in the form of one of the train protection systems listed below, or the first train protection system and the second train protection system are in the form of a combination of two or more of the train protection systems cited below:

ETCS (European Train Control System),

LZB (continuous train control system),

PZB (intermittent train control system), the SCMT (Sistema di Controllo della Marcia del Treno) system, the MIREL system, the SHP (Samoczynne Hamowanie Pociagu) system, the TGBI (Train Guard Basic Indusi) system, the ATC/STM-DK system, the ATB-EG system, the ATC2 (Automatic Train Control) system.

In a preferred development, the locomotive as the rail vehicle is part of a train configuration, the locomotive being arranged at a first end of the train configuration in order to drive said train configuration.

The train configuration additionally has a control car that is arranged at a second end of the train configuration, which is opposite the first end of the train configuration.

In reference to the train configuration the locomotive has a driver's cab referred to as the first driver's cab, while in reference to the train configuration the control car has a driver's cab referred to as the second driver's cab. The movement of the train configuration is controlled either by way of the first driver's cab or by way of the second driver's cab.

As described above, the locomotive has the train protection system, said train protection system being designed both for movement control by way of the first driver's cab and for movement control by way of the second driver's cab.

For use as a lead rail vehicle of the train formation, the control car likewise has components of an actuator system and components of a sensor system that are arranged on the control car close to the rails.

The actuator system and the sensor system of the control car have, as respective elements, antennas designed to allow the actuator system and the sensor system to communicate with components of the train protection system that are arranged on the track.

The actuator system and the sensor system of the control car are connected to the first gateway by way of a second gateway.

The second gateway likewise has a mediator functionality, and so a cable-length-independent connection is able to be made between the actuator system and the sensor system of the control car on the one hand and the train protection system of the locomotive on the other hand.

From the point of view of the actuator system and the sensor system of the control car the second gateway simulates an input interface of the locomotive-sited train protection system.

From the point of view of the first gateway the second gateway simulates an extension for connecting the actuator system and the sensor system of the control car.

The second gateway is thus used to provide the train protection system with required antenna signals of the actuator system and the sensor system of the control car as additional signals by way of the first gateway.

In a preferred development, the locomotive-sited components of the actuator system are of identical design to the control-car-sited components of the actuator system.

In a preferred development, the locomotive-sited components of the sensor system are of identical design to the control-car-sited components of the sensor system.

In a preferred development, the second gateway is connected to the first gateway via a bus-based data connection, preferably via an Ethernet bus.

The train configuration is then driven by way of the locomotive.

Use of the gateway permits another actuator system or sensor system to be connected without influencing the train protection system, and so the train protection system can continue to use its previous interfaces without alteration.

Use of gateway the permits cable-length-independent connection of the antennas, or of the associated sensor system/actuator system, to the train protection system.

The present invention reduces control engineering and hardware required in the train configuration under consideration.

The present invention saves development effort and the effort of registrations for hardware and software.

The present invention saves development costs.

The present invention achieves a simple architecture at device and software level that is able to be altered or adapted with corresponding ease.

The present invention achieves simple software release management. The elimination of software components that need to be updated in parallel results in much lower maintenance effort and lower costs within a product platform.

The present invention achieves standardization of the locomotives of a platform with associated train configurations.

The present invention permits a standard, convenient registration method with a technically simple safety concept.

The present invention reduces time-to-market time and achieves better compatibility of products and greater customer benefit.

The invention is explained in more detail below by way of illustration with reference to a drawing, in which:

DETAILED DESCRIPTION OF THE INVENTION

Figure 1:
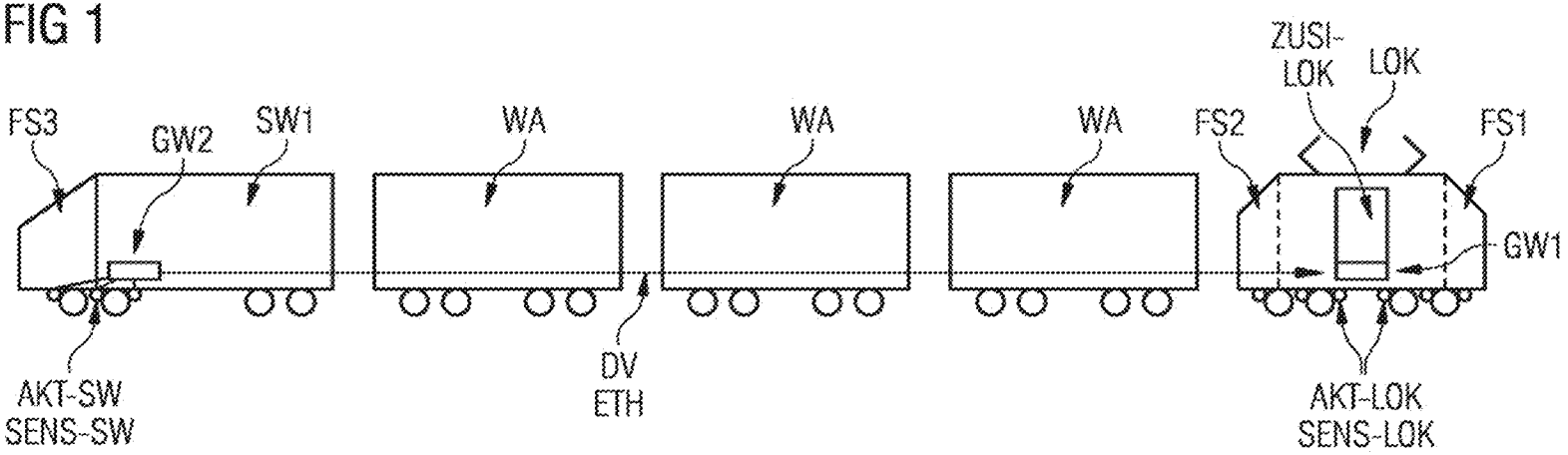
FIG. 1 shows a representation of the arrangement for train protection according to the invention on the basis of a train configuration.

FIG. 1 shows a representation of the arrangement according to the invention for train protection of a train configuration.

The train configuration encompasses a locomotive LOK comprising a driver's cab FS1, multiple cars WA and a control car SW, which has a so-called operating head comprising a driver's cab FS3.

The control car SW is arranged at a first end of the train configuration, while the locomotive LOK is arranged at an opposite second end of the train configuration.

The train configuration is driven by way of the locomotive LOK, which, besides the driver's cab FS1, also has another driver's cab FS2, which is not used in this application.

The movement of the train configuration is monitored, or controlled, in the manner of the conventional "push-pull concept" either by way of the driver's cab FS1 of the locomotive or by way of the driver's cab FS3 of the control car SW.

When the movement of the train configuration is being monitored, or controlled, by way of the driver's cab FS1, referred to as the first driver's cab, of the locomotive LOK, a train protection system ZUSI-LOK that is provided, or arranged, on the locomotive LOK is used for this purpose.

The train protection system ZUSI-LOK is coupled to components of an associated actuator system AKT-LOK and to components of a sensor system SENS-LOK that are arranged on the locomotive LOK close to the rails.

When the movement of the train configuration is being monitored, or controlled, by way of the driver's cab FS3, referred to as the second driver's cab, of the control car SW, the train protection system ZUSI-LOK of the locomotive LOK is also used for this purpose.

The train protection system ZUSI-LOK is, for this purpose, coupled to components of an associated actuator system AKT-SW and to components of a sensor system SENS-SW that are arranged on the control car SW and close to the rails that are being used.

The comparable components AKT-SW and SENS-SW and AKT-LOK and SENS-LOK are of identical or similar design, but show the same functionality and are therefore present twice. They are operated by way of the train protection system ZUSI-LOK, however, which is present only once.

The control car SW and the locomotive LOK, for this purpose, use a bus-based connection to communicate with one another, said connection being depicted by way of illustration as an Ethernet bus ETH of a data connection DV.

The Ethernet bus ETH of the data connection DV is used to exchange the following control signals, for example:

control signals from the driver's cab FSA-SW of the control car SW control signals from and to the subsystems STGSUB-SW of the control car SW signals from and to the actuators AKT-SW and sensors SENS-SW of the train protection systems etc.

The train protection system ZUSI-LOK is coupled to the locomotive-sited components of the actuator system AKT-LOK and to the locomotive-sited components of the sensor system SENS-LOK by way of a first gateway GW1, the actuator system AKT-LOK and the sensor system SENS-LOK being arranged on the locomotive LOK close to the rails.

The train protection system ZUSI-LOK is coupled to the control-car-sited components of the actuator system AKT-SW and to the control-car-sited components of the sensor system SENS-SW by way of a second gateway GW2, the actuator system AKT-SW and the sensor system SENS-SW being arranged on the control car SW close to the rails.

The respective actuator system AKT-LOK, AKT-SW and sensor system SENS-LOK, SENS-SW have, as an element, respective antennas that the respective actuator system or sensor system uses to communicate with associated components that are arranged, or provided, on the track as an element of the train protection system ZUSI-LOK.

The first and second gateways GW1, GW2 have a mediator functionality, and so a length-independent connection is able to be made, or is permitted, between the actuator system or the sensor system on the one hand and the train protection system on the other hand.

From the point of view of the respective actuator system or sensor system the associated gateway simulates an input interface of the train protection system.

From the point of view of the train protection system the two gateways simulate input interfaces of the respective actuator system and sensor system. They provide required antenna signals for the train protection system.

Figure 2:
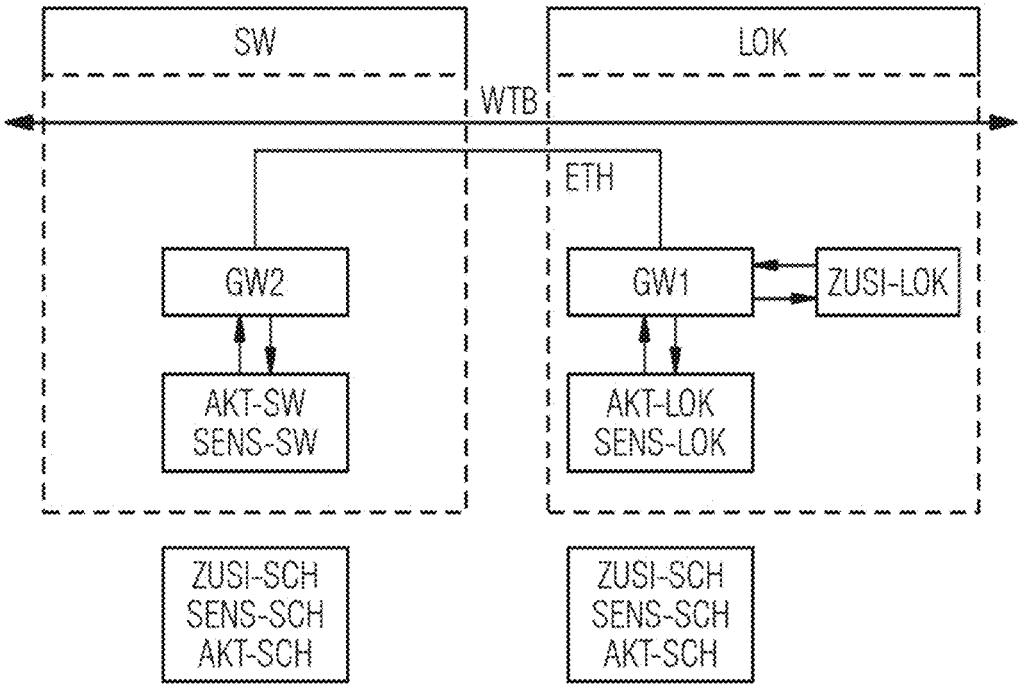
FIG. 2 shows a schematic representation of an associated architecture with reference to FIG. 1.
Figure 3:
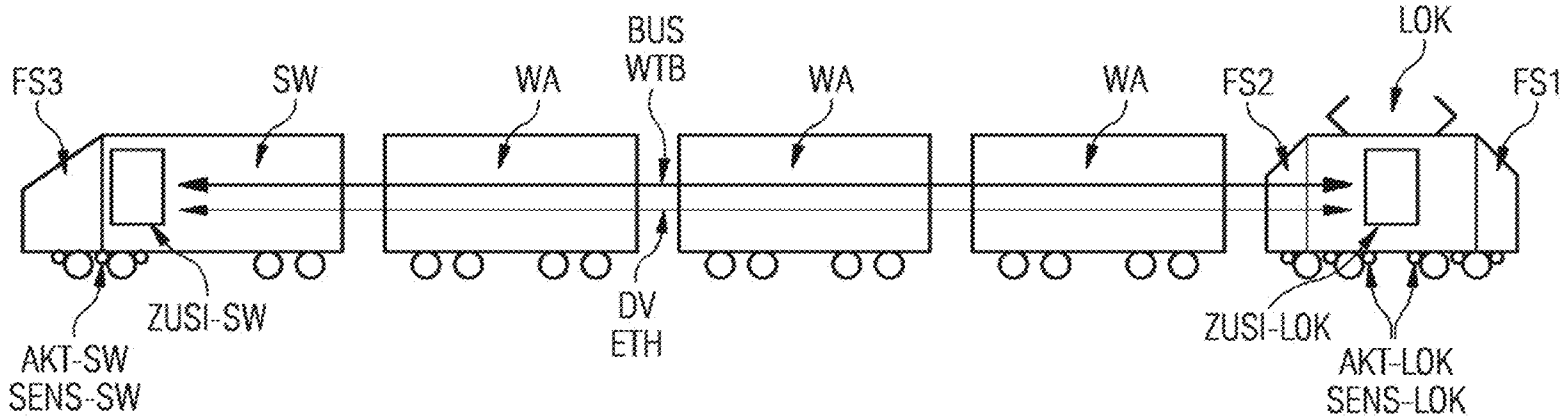
FIG 3 Prior art
FIG. 3 shows the train configuration according to the prior art that was described at the outset.
Figure 4:
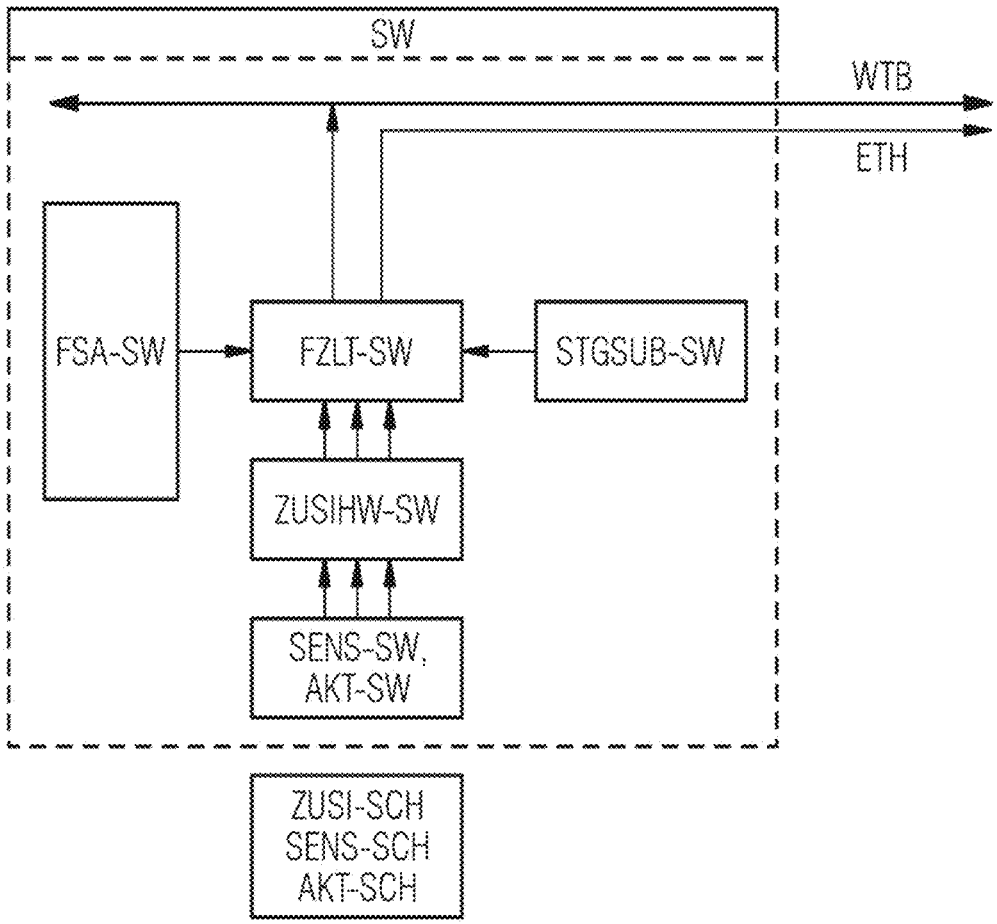
FIG 4 Prior art
FIG. 4 shows the schematic representation of the control system architecture of the control car according to the prior art that was described at the outset, with reference to FIG. 3.

FIG. 2 shows a schematic representation of an associated architecture with reference to FIG. 1.

On the control car, the components of the actuator system AKT-SW and the components of the sensor system SENS-SW are coupled to associated components of an actuator system AKT-SCH and components of a sensor system SENS-SCH, respectively, that are elements of rail-sited train protection ZUSI-SCH.

The control-car-sited components of the actuator system AKT-SW and of the sensor system SENS-SW are connected to the first gateway GW1 via an Ethernet-based data connection ETH by way of a control-car-sited gateway GW2.

On the locomotive, the components of the actuator system AKT-LOK and the components of the sensor system SENS-LOK are coupled to the associated components of the actuator system AKT-SCH and components of the sensor system SENS-SCH, respectively, that are elements of the rail-sited train protection ZUSI-SCH.

The locomotive-sited components of the actuator system AKT-SW and of the sensor system SENS-SW are connected to the locomotive-sited train protection system ZUSI-LOK by way of the locomotive-sited first gateway GW1.

The signal transmission of the respective actuator system or sensor system is performed by means of the two gateways GW1, GW2.

The respective actuator system and sensor system have, as an element, respective antennas that the respective actuator system or sensor system uses to communicate with the rail-sited components arranged, or provided, on the track as an element of the train protection system.

The first and second gateways GW1, GW2 have a mediator functionality, and so a length-independent connection is able to be made, or is permitted, between the actuator system or sensor system on the one hand and the train protection system on the other hand.

From the point of view of the respective actuator system or sensor system the two gateways simulate an input interface of the train protection system ZUSI-LOK.

From the point of view of the train protection system ZUSI-LOK the first gateway GW1 simulates input interfaces of the respective actuator system and sensor system that provide required antenna signals for the train protection system.

From the point of view of the first gateway GW1 the second gateway GW2 simulates an extension for connecting the actuator system and the sensor system of the control car.

The invention claimed is:

1. An arrangement for train protection, comprising:

a rail vehicle to be supported on rails of a track, said rail vehicle having a driver's cab and a train protection system forming a first train protection system;

said train protection system being connected, by way of a first gateway, to components of an actuator system and to components of a sensor system;

said actuator system and said sensor system being arranged on said rail vehicle in a vicinity of the rails;

said actuator system and said sensor system having, as respective elements, antennas configured to enable said actuator system and said sensor system to communicate with track-side components of the train protection system;

said first gateway having a mediator functionality for realizing a line-length-independent connection of said actuator system and said sensor system with said train protection system;

wherein said first gateway is configured to simulate an input interface of the train protection system of the rail vehicle for said actuator system and said sensor system;

wherein said first gateway is configured to simulate an input interface of said actuator system and said sensor system for the train protection system; and said first gateway being used to provide required antenna signals of said actuator system and said sensor system for the train protection system.

2. The arrangement according to claim 1, wherein said first gateway is configured, in addition to said actuator system and said sensor system of said first train protection system, to enable an actuator system and a sensor system of a second train protection system to be connected to said first gateway at the same time, and wherein said second train protection system is also arranged on said rail vehicle.

3. The arrangement according to claim 2, wherein:

said first train protection system is a train protection system selected from the group consisting of the following train protection systems; or said first train protection system and said second train protection system are a combination of two or more train protection systems selected from the group consisting of the following train protection systems:

a European Train Control System (ETCS), a continuous train control system (LZB)

an intermittent train control system (PZB), a Sistema di Controllo della Marcia del Treno (SCMT) system, a MIREL train protection system and train control system, a Samoczynne Hamowanie Pociagu (SHP) system, the Train Guard Basic Indusi (TGBI) system, an automatic train control, specific transmission module (ATC/STM-DK) system, the Dutch automatic train control system (ATB EG), and the Automatic Train Control (ATC2) system.

4. The arrangement according to claim 1, wherein:

said first train protection system is a train protection system selected from the group consisting of:

a European Train Control System (ETCS)

a continuous train control system (LZB), an intermittent train control system (PZB)

the Sistema di Controllo della Marcia del Treno (SCMT) system, the MIREL train protection system and train control system, the Samoczynne Hamowanie Pociagu (SHP), system, the Train Guard Basic Indusi (TGBI), system an automatic train control, specific transmission module (ATC/STM-DK) system, the Dutch automatic train control system (ATB EG), and the Automatic Train Control (ATC2) system.

5. The arrangement according to claim 1, wherein:

the rail vehicle is a locomotive forming a part of a train configuration having a first end and a second end opposite said first end;

said locomotive is arranged at said first end of said train configuration in order to drive said train configuration;

said train configuration includes a control car arranged at said second end of said train configuration;

with reference to said train configuration, said locomotive has a driver's cab being a first driver's cab;

with reference to said train configuration, said control car has a driver's cab being a second driver's cab;

wherein a movement of said train configuration can be controlled either by way of said first driver's cab or by way of said second driver's cab; and said train protection system of said locomotive is configured for movement control by way of said first driver's cab and for movement control by way of said second driver's cab.

6. The arrangement according to claim 5, wherein:

for use as a lead rail vehicle of said train configuration, said control car also has components of an actuator system and components of a sensor system that are arranged on the control car in the vicinity of the rails;

said actuator system and said sensor system of said control car have, as respective elements, antennas configured to enable said actuator system and said sensor system of said control car to communicate with the track-side components of said train protection system.

7. The arrangement according to claim 6, wherein said actuator system and said sensor system of said control car are connected to said first gateway by way of a second gateway.

8. The arrangement according to claim 7, wherein:

said second gateway includes a mediator functionality, enabling a line-length-independent connection to be made between said actuator system and said sensor system of said control car and said train protection system of said locomotive;

said second gateway is configured to simulate an input interface of the train protection system for said actuator system and said sensor system of said control car;

said second gateway forms an extension of said first gateway for connecting said actuator system and said sensor system of said control car; and said second gateway provides said train protection system with required antenna signals of said actuator system and said sensor system of said control car as additional signals by way of said first gateway.

9. The arrangement according to claim 7, wherein said second gateway is connected to said first gateway via a bus-based data connection.

10. The arrangement according to claim 9, wherein said second gateway is connected to said first gateway via an Ethernet bus.

* * * * *